US009216132B2

(12) United States Patent
Aoki et al.

(10) Patent No.: US 9,216,132 B2
(45) Date of Patent: Dec. 22, 2015

(54) BALANCE DEVICE

(75) Inventors: Eisuke Aoki, Nagakute (JP); Hitoshi Konosu, Nagoya (JP); Hidenori Kimura, Wako (JP); Tytus Wojtara, Wako (JP); Shingo Shimoda, Wako (JP)

(73) Assignee: TOYOTA JIDOSHA KABUSHIKI KAISHA, Toyota-Shi (JP)

( * ) Notice: Subject to any disclaimer, the term of this patent is extended or adjusted under 35 U.S.C. 154(b) by 777 days.

(21) Appl. No.: 13/516,160

(22) PCT Filed: Sep. 22, 2010

(86) PCT No.: PCT/JP2010/066405

§ 371 (c)(1),
(2), (4) Date: Jun. 14, 2012

(87) PCT Pub. No.: WO2011/074299

PCT Pub. Date: Jun. 23, 2011

(65) Prior Publication Data

US 2012/0253247 A1 Oct. 4, 2012

(30) Foreign Application Priority Data

Dec. 15, 2009 (JP) ..... 2009-284387

(51) Int. Cl.
*A61H 1/00* (2006.01)
*A61H 1/02* (2006.01)
(Continued)

(52) U.S. Cl.
CPC ..... *A61H 3/00* (2013.01); *A63B 21/0004* (2013.01); *A63B 21/0058* (2013.01);
(Continued)

(58) Field of Classification Search
CPC ..... A61H 1/00; A61H 1/02
USPC ..... 601/5, 23; 74/5 R, 5.4, 5.41, 5.47, 5.95; 600/595
See application file for complete search history.

(56) References Cited

U.S. PATENT DOCUMENTS 8,974,232 B2 * 3/2015 Behrenbruch et al. ..... 434/258
2006/0070646 A1 * 4/2006 Denman ..... 135/66
(Continued)

FOREIGN PATENT DOCUMENTS

DE 202 16 973 U1 3/2003
EP 1 074 218 A1 2/2001
(Continued)

OTHER PUBLICATIONS

International Preliminary Report on Patentability with Written Opinion of PCT/JP2010/066405.
(Continued)

*Primary Examiner* — Justine Yu
*Assistant Examiner* — Kathrynn Reilly
(74) *Attorney, Agent, or Firm* — Kenyon & Kenyon LLP

(57) ABSTRACT

A device that supports a motion for restoring an inclination angle of a body to a reference direction is provided. A balance device includes a sensor, at least one flywheel, and a controller. The sensor is configured to detect an inclination angle of the body with respect to the reference direction. The at least one flywheel is arranged on the balance device so that an axis of the flywheel is non-parallel to a yaw axis of the body when the balance device is attached to a user. The yaw axis of the body corresponds to a longitudinal direction of the body. In addition, the yaw axis coincides with the reference direction when the user stands erect. The controller is configured to change a rotation rate of the flywheel based on an inclination angle detected by the sensor.

5 Claims, 8 Drawing Sheets

(51) Int. Cl.

| | |
|---|---|
| ***A61H 5/00*** | (2006.01) |
| ***A61H 3/00*** | (2006.01) |
| ***A63B 21/00*** | (2006.01) |
| ***A63B 26/00*** | (2006.01) |
| ***A63B 21/005*** | (2006.01) |
| *A63B 21/22* | (2006.01) |

(52) U.S. Cl.

CPC .... *A63B 21/00178* (2013.01); *A63B 21/00181* (2013.01); *A63B 21/1419* (2013.01); *A63B 21/1449* (2013.01); *A63B 21/1484* (2013.01); *A63B 26/003* (2013.01); *A61H 2201/165* (2013.01); *A61H 2201/5007* (2013.01); *A61H 2201/5069* (2013.01); *A61H 2201/5079* (2013.01); *A61H 2230/625* (2013.01); *A63B 21/225* (2013.01); *A63B 2220/16* (2013.01); *A63B 2220/24* (2013.01)

(56) References Cited

U.S. PATENT DOCUMENTS

| | | | | |
|---|---|---|---|---|
| 2007/0257451 | A1 | 11/2007 | Furuta et al. | |
| 2008/0164083 | A1 | 7/2008 | Miki et al. | |
| 2009/0076421 | A1 | 3/2009 | Grant, Jr. | |
| 2010/0193265 | A1 | 8/2010 | Furuta et al. | |
| 2010/0198493 | A1 | 8/2010 | Furuta et al. | |
| 2012/0029696 | A1 * | 2/2012 | Ota et al. | 700/250 |

FOREIGN PATENT DOCUMENTS

| | | | |
|---|---|---|---|
| EP | 1 792 597 | A1 | 6/2007 |
| JP | 2509921 | U | 6/1996 |
| JP | 11-299759 | A | 11/1999 |
| JP | 2002-159541 | A | 6/2002 |
| JP | 2002-336315 | A | 11/2002 |
| JP | 2004-009205 | A | 1/2004 |
| JP | 2005-245637 | A | 9/2005 |
| JP | 2007-038962 | A | 2/2007 |
| JP | 2007-082915 | A | 4/2007 |
| JP | 2007-185761 | A | 7/2007 |
| JP | 2008-539976 | A | 11/2008 |
| JP | 2009-254741 | A | 11/2009 |
| WO | 2006/022057 | A1 | 3/2006 |

OTHER PUBLICATIONS

Supplementary European Search Report of EP 10 83 7329 mailed Aug. 22, 2012.

International Search Report mailed Dec. 28, 2010 of PCT/JP2010/066405.

* cited by examiner

BALANCE DEVICE

This is a 371 national phase application of PCT/JP2010/066405 filed 22 Sep. 2010, claiming priority to Japanese Patent Application No. 2009-284387 filed 15 Dec. 2009, the contents of which are incorporated herein by reference.

TECHNICAL FIELD

The present invention claims a priority based on Japanese Patent Application No 2009-284387 filed on Dec. 15, 2009, the contents of which are hereby incorporated by reference into the present application. The present invention relates to a technique for supporting a user's balance ability using a flywheel or to a technique for training to improve balance ability. In the present specification, "balance ability" typically means an ability to recover an inclined body to a predetermined reference direction.

DESCRIPTION OF RELATED ART

To the best of the present inventors' knowledge, attachable devices for supporting a user's balance ability have hardly been studied to date. As will be described later, a novel technique disclosed in the present specification uses a flywheel. In consideration thereof, two examples of prior art related to robot technology using the flywheel will be listed below.

(1) Patent Document 1 (Japanese Patent Application Publication No. 2004-9205): A legged robot disclosed in Patent Document 1 is equipped with a control moment gyro that uses a flywheel in at least one of a body and a leg. The legged robot changes a posture of the body using the control moment gyro.

(2) Patent Document 2 (Japanese Patent Application Publication No. 2009-254741): Patent Document 2 discloses a walking assist device that uses a flywheel. The walking assist device comprises a first attached part that is mounted to an upper thigh and a second attached part that is mounted to a lower thigh. Each attached part comprises a flywheel. The walking assist device uses a reaction torque of the flywheel to support leg motion.

SUMMARY OF INVENTION

Technical Problem

A person's balance ability may decline due to a disability or an injury. However, as mentioned earlier, to the best of the present inventors' knowledge, attachable devices for supporting a user's balance ability have hardly been studied to date. An attachable device that supports the balance ability is desired for people with impaired balance ability. Moreover, an attachable balance support device can also be used as a training device for improving the balance ability.

Solution to Technical Problem

A technique disclosed in the present specification provides a balance device to be attached to a body of a user. The balance device comprises a sensor, at least one flywheel, and a controller. The sensor is configured to detect an inclination angle of the body with respect to a predetermined reference direction. An example of the reference direction is a vertical direction. The reference direction can be determined by inclining the balance device in a desired direction and resetting the inclination angle outputted by the sensor to zero. In this case, a direction of the balance device when the sensor outputs the inclination angle of zero corresponds to the reference direction. The at least one flywheel is arranged on the balance device so that an axis of the flywheel is non-parallel to a yaw axis of the body when the balance device is attached to the user. The yaw axis of the body corresponds to a longitudinal direction of the body. In addition, the yaw axis coincides with the vertical direction when the user maintains upright posture. The controller is configured to change a rotation rate of the flywheel based on the inclination angle detected by the sensor.

The balance device described above supports a user's balance ability using a reaction torque induced by a change in the rotation rate of the flywheel. In this case, the reaction torque refers to a torque that the body receives from the flywheel. Hereinafter, the reaction torque induced by the change in the rotation rate of the flywheel will simply be referred to as a "reaction torque". In addition, the balance device described above can be used as a training device for improving the user's balance ability by appropriately changing a relationship between the inclination angle and the change in the rotation rate of the flywheel. By controlling the balance device described above so as to induce the reaction torque in a direction by which the inclination angle of the body is returned toward the reference direction, the balance device functions as a balance support device. On the other hand, by controlling the balance device described above so as to induce the reaction torque in a direction by which the inclination angle of the body is increased (in a direction away from the reference direction), the balance device functions as the balance training device.

In a case of the balance device having one flywheel, the relationship among the direction of an inclination angle, the rotation direction of the flywheel, and the direction of the reaction torque is as follows. Let us assume the inclination angle of the body within a plane that intersects a rotation axis of the flywheel. When the body is inclined in a clockwise direction with respect to the reference direction, increasing the rotation rate of the flywheel in the clockwise direction induces the reaction torque in a counter clockwise direction with respect to the body or, in other words, the reaction torque in the direction by which the inclination angle of the body is returned toward the reference direction. In a case in which a plurality of flywheels is provided, the rotation rate of each flywheel is changed so that a resultant reaction torque of reaction torques induced by the respective flywheels acts in the direction by which the inclination angle is returned toward the reference direction. Direction and magnitude of the resultant torque are determined by a geometric arrangement of the respective flywheels.

An embodiment in which the aforementioned balance device is used as a balance ability support device will now be described. A controller of the balance device is configured to control a rotation rate of the flywheel to keep a reaction torque at equal to or less than a predetermined reaction threshold when the inclination angle is in a predetermined first range that includes the reference direction, and to change the rotation rate of the flywheel so that the reaction torque acts in a direction by which the inclination angle is returned toward the reference direction with a magnitude not less than the reaction threshold when the inclination angle exceeds the first range.

In a case of the balance device comprising one flywheel, the controller is configured to control the flywheel so as to increase the rotation rate of the flywheel in a same rotation direction as the direction of inclination when the inclination angle is outside of the first range. Such a rotation angular velocity (rotation rate) of the flywheel induces the reaction torque that acts in the direction by which the inclination angle of the body is returned toward the reference direction.

In another embodiment in which the aforementioned balance device is used as the balance support device, the controller is configured to: change the rotation rate of the flywheel so that the reaction torque acts in the direction by which the inclination angle is returned toward the reference direction with the magnitude greater than the reaction threshold when the inclination angle increases; and control the rotation rate of the flywheel to keep the reaction torque at equal to or less than the reaction threshold when the inclination angle decreases.

In the former case, when a deviation of the inclination angle from the reference direction increases, the reaction torque is applied to the body in the direction by which the inclination angle is returned toward the reference direction. In the latter case, when the inclination angle of the body increases, the reaction torque is applied to the body in the direction by which the inclination angle is returned toward the reference direction. Through such operations, the balance device supports the user's balance ability. In both cases, the reaction threshold is set in advance to a small value that does not affect the balance of the user. Favorably, the reaction threshold is substantially zero.

A configuration is also preferable in which the rotation rate of the flywheel is changed by combining a condition regarding the range of the detected inclination angle and a condition regarding the direction of change in the inclination angle. For example, the controller favorably changes the rotation rate of the flywheel under the following three conditions. (Condition 1): When the inclination angle is in the first range, the controller controls the rotation rate of the flywheel to keep the reaction torque at equal to or less than the reaction threshold regardless of a change in the inclination angle. (Condition 2): When the inclination angle is out of the first range and the inclination angle increases, the controller changes the rotation rate of the flywheel so that the reaction torque acts in the direction by which the inclination angle is returned toward the reference direction with the magnitude greater than the reaction threshold. (Condition 3): When the inclination angle is out of the first range and the inclination angle decreases, the controller changes the rotation rate of the flywheel to keep the reaction torque at equal to or less than the reaction threshold.

The meanings of the above three conditions will now be described. When the inclination angle is in the first range, since the user is maintaining balance, the reaction torque is not required (Condition 1). Since a decrease in the inclination angle indicates that balance is being recovered under the user's own power, the reaction torque is not required even if the inclination angle is out of the first range (Condition 3). Since an inability of the user to recover balance is only likely when the inclination angle is out of the first range and increases, the balance recovery is supported by the reaction torque (Condition 2). As shown, by combining the condition regarding the range of the detected inclination angle and the condition regarding the direction of change in the inclination angle, the balance recovery can be supported in a more appropriate manner.

According to an embodiment of the novel technique disclosed in the present specification, the controller is favorably configured to reduce the rotation rate of the flywheel to zero while controlling the rotation rate of the flywheel to keep the reaction torque at equal to or less than the reaction threshold. A balance device with such a configuration reduces the rotation rate of the flywheel to zero when the inclination angle of the body is close to vertical or, in other words, when the user is maintaining balance. With such a balance device, a gyroscopic effect is not created if the rotation of the flywheel stops when the user is maintaining balance, and an unnecessary gyroscopic torque is not supplied when the body wobbles. In addition, by reducing the rotation rate of the flywheel to zero, a saturation of the rotation rate can be prevented. A gyroscopic torque is a torque that is induced due to a change in an axis of a rotating flywheel. The gyroscopic torque may be induced even by the flywheel rotating at a constant rate.

The controller may reduce the rotation rate to zero using a mechanical frictional resistance of the flywheel. Such a balance device is capable of suppressing power consumption.

An embodiment in which the aforementioned balance device is used as a training device for improving balance ability will now be described. A controller is configured to change a rotation rate of a flywheel so that a reaction torque acts in a direction by which an inclination angle is increased when the inclination angle is in a predetermined second range (an initial range) that includes a reference direction (includes the inclination angle=0). In addition, the controller is configured to control the rotation rate of the flywheel to keep the reaction torque at equal to or less than a reaction threshold when the inclination angle goes out from the initial range.

With the balance device described above, when a direction of the body is close to the reference direction (the inclination angle is close to zero) or, in other words, when the user is maintaining balance, the reaction torque is applied in the direction by which the inclination angle of the body is increased. The user of the balance device attempts to maintain balance against the reaction torque. By repeating such a motion, the user's balance ability is trained.

Furthermore, favorably, the controller of the balance device described above is configured to change the rotation rate of the flywheel so that the reaction torque acts in a direction by which the inclination angle is returned toward the reference direction (toward the inclination angle=0) with a magnitude greater than the reaction torque threshold when the inclination angle is greater than the third range (an adjacent range which is defined as a range outside the initial range). When the body inclines drastically even during training, such a balance device can support the balance ability of the user and promptly recover the inclination angle of the user.

Favorably, the controller is also configured to reduce the rotation rate of the flywheel to zero while controlling the rotation rate of the flywheel to keep the reaction torque at equal to or less than the reaction threshold when the inclination angle is in the third range (the adjacent range). By reducing the rotation rate of the flywheel to zero, generation of unnecessary gyroscopic torque can be suppressed. The controller may reduce the rotation rate to zero using a mechanical frictional resistance of the flywheel. Such a balance device is capable of suppressing power consumption.

The balance device comprising one flywheel can accommodate a change in an inclination angle around one axis. The balance device comprising two flywheels with axes arranged non-parallel to each other can accommodate inclination angles around two axes. The balance device comprising three flywheels arranged in a special interrelationship can accommodate changes in inclination angles around two axes that intersect the yaw axis of the body and a change in a traverse angle of the body around the yaw axis. The "special interrelationship" corresponds to a relationship in which respective axes of the three flywheels are non-parallel with one another and in which the three axes are not arranged on one plane. The balance device having such a special interrelationship is capable of supporting/training the ability of the user not only in regards to the inclination angle of the body but also in regards to the traverse angle of the body.

Typically, the aforementioned functions of the balance device may be realized by a program executed by a controller of the balance device. In addition, a recording medium on which such a program is recorded is also one embodiment of the technique disclosed in the present specification.

Advantageous Effects of Invention

According to a novel technique disclosed in the present specification, a device that supports a user's balance ability or a training device for improving a user's balance ability can be provided. In particular, a balance device configured to reduce the rotation rate of the flywheel to zero in predetermined cases described above prevents unnecessary gyroscopic torque from being applied to a user.

DETAILED DESCRIPTION OF INVENTION

First Embodiment

A balance device 10 according to the first embodiment will be described with reference to the drawings. The balance device 10 supports a user's motion for recovering an inclination angle of a body to a vertical direction. The balance device 10 comprises a corset 12 for mounting the balance device 10 to the body (waist) of the user and a flywheel 20. The flywheel 20 is positioned on the back of a user 91 when the balance device 10 is attached to the user 91.

Figure 1A:
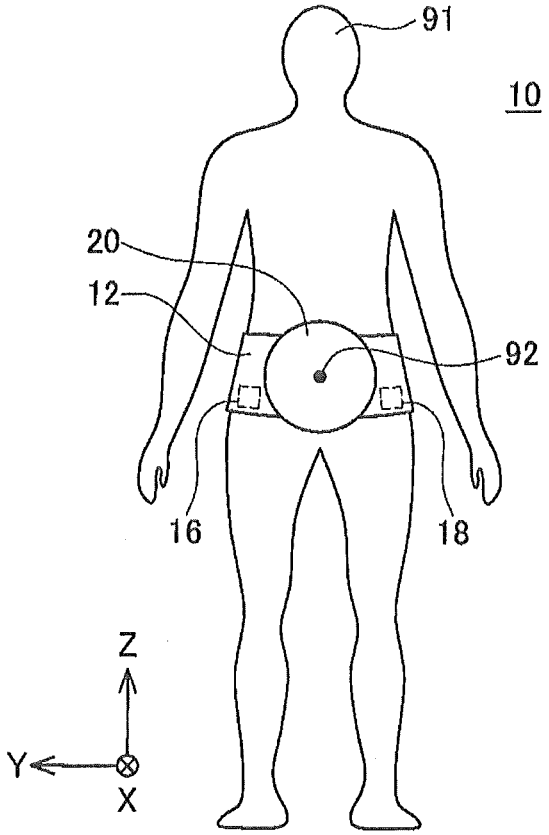
FIG. 1A is a schematic front view of a balance device according to a first embodiment.
Figure 1B:
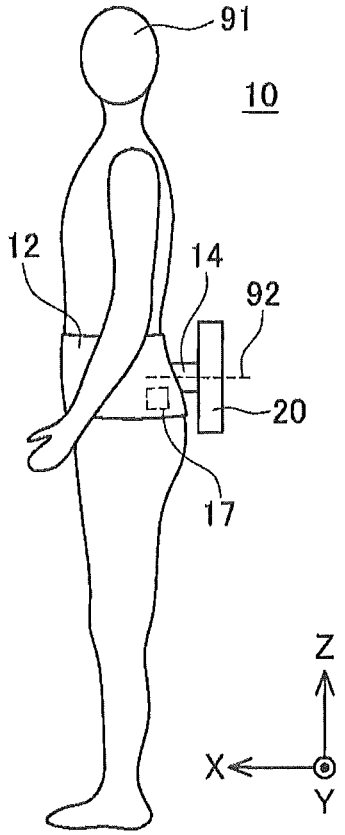
FIG. 1B is a schematic side view of the balance device according to the first embodiment.
Figure 1C:
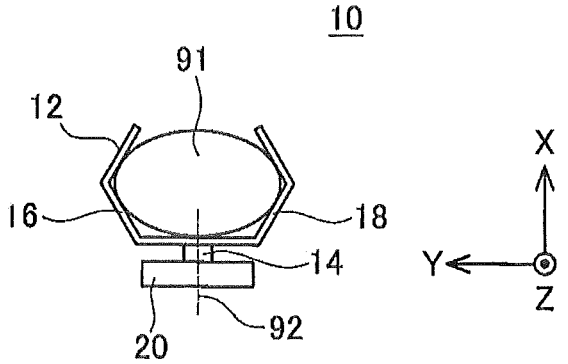
FIG. 1C is a schematic plan view of the balance device according to the first embodiment.

FIGS. 1A to 1C show three diagrams of the balance device 10 when being attached to the user 91. FIG. 1A shows a front view, FIG. 1B shows a side view, and FIG. 1C shows a plan view. Moreover, in FIG. 1C, the user 91 is schematically depicted by an ellipse. Furthermore, since the flywheel 20 is positioned on a back side of the user 91, the back of the user 91 is drawn in FIG. 1A.

A coordinate system used in the following description will be explained. The front of the user 91 corresponds to an X axis, the sides of the user 91 correspond to a Y axis, and a direction perpendicular to both the X axis and the Y axis corresponds to a Z axis. In robotics, the X axis, the Y axis, and the Z axis are respectively referred to as a roll axis, a pitch axis, and a yaw axis. The present specification also mainly uses the terms roll axis, pitch axis, and yaw axis. The yaw axis coincides with a longitudinal direction of the body. More specifically, the yaw axis corresponds to a straight line which passes through a center of the body and which extends in the longitudinal direction of the body.

A motor 14 is mounted to the corset 12. The motor 14 rotates the flywheel 20. The flywheel 20 is covered by a cover. The flywheel 20 is arranged so that when the balance device 10 is attached to the user 91, a rotation axis 92 of the flywheel 20 intersects the yaw axis of the body of the user 91. Hereinafter, the rotation axis 92 will be simply referred to as an axis 92. In the case of the balance device 10 according to the present embodiment, the axis 92 of the flywheel 20 extends along a direction of the roll axis of the user 91.

Moreover, the flywheel 20 need only be arranged so that when the balance device 10 is attached to the user 91, the rotation axis 92 of the flywheel 20 is non-parallel to the yaw axis. Such an arrangement enables the balance device to induce a reaction torque around a straight line that intersects the yaw axis and to support an inclination angle.

Furthermore, a controller 16, a battery 17, and an inclination angle sensor 18 are installed in the corset 12. The inclination angle sensor 18 measures an inclination angle of the corset 12 with respect to a reference direction or, in other words, an inclination angle of the body of the user 91. The reference direction is determined by resetting the inclination angle sensor 18 while pointing the balance device 10 in a desired direction so that an inclination angle of zero is outputted by the inclination angle sensor 18. Hereinafter, the inclination angle sensor 18 is to be reset when the balance device 10 is attached to the user and the yaw axis of the user's body coincides with the vertical direction. That is, in the present embodiment, a case in which the yaw axis of the body coincides with the vertical direction corresponds to the inclination angle of zero. In other words, the inclination angle corresponds to an angle between a vertical line and the yaw axis. The controller 16 is configured to control a rotation rate of the flywheel 20 based on the inclination angle detected by the inclination angle sensor 18. The battery 17 supplies power to the controller 16, the inclination angle sensor 18, and the motor 14.

Figure 2:
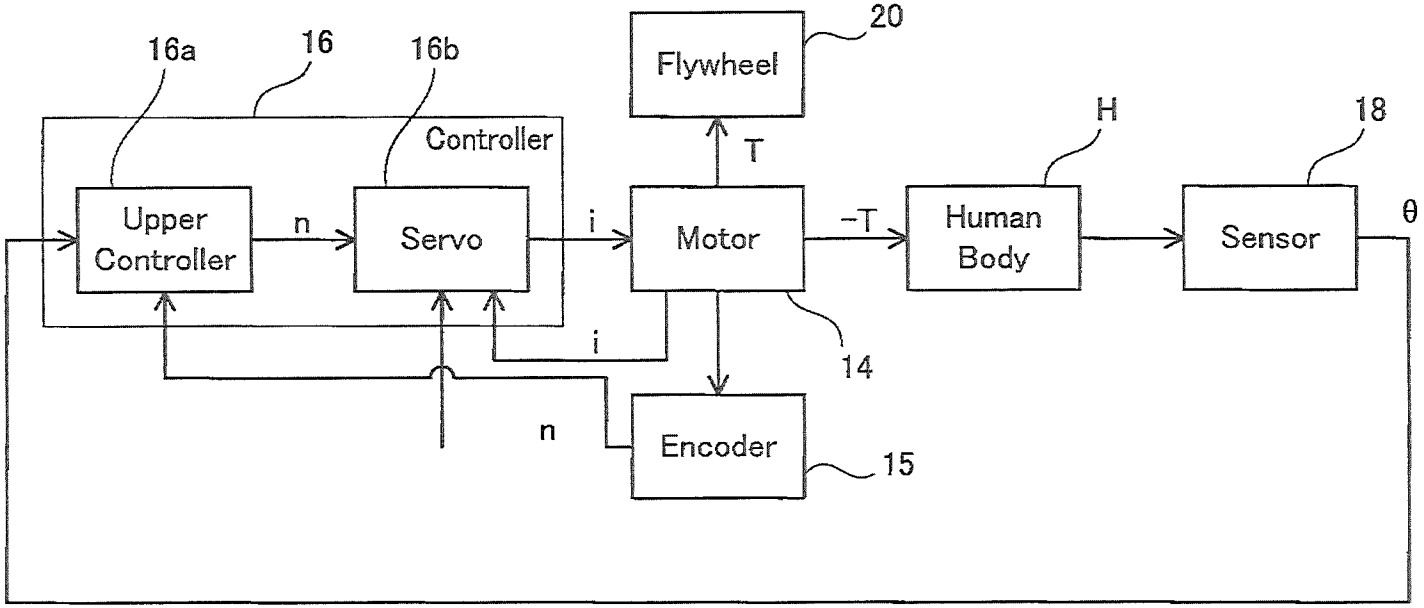
FIG. 2 is a block diagram of a balance device.

FIG. 2 shows a block diagram of the balance device 10. In detail, the controller 16 comprises an upper controller 16*a* and a servo controller 16*b*. Based on an inclination angle θ outputted by the inclination angle sensor 18 and a rotation rate (rotation speed) of the motor 14 that is measured by an encoder 15, the upper controller 16*a* outputs, to the servo controller 16*b*, a commanded rotation rate n (rpm) for the motor 14 so that a desired reaction torque "−T" is induced. In this case, the reaction torque "−T" can be induced by having the motor 14 accelerate the rotation of the flywheel 20 at a torque T. By changing the commanded rotation rate n for the motor 14, the motor 14 generates the torque. When the motor 14 applies the torque T to the flywheel 20, the reaction torque "−T" acts on the user 91 via the motor 14. A detailed description of the reaction torque will be given later. The servo controller 16*b* performs feedback control on the motor 14 so that the rotation rate of the motor 14 follows the commanded rotation rate n. The servo controller 16*b* controls the motor 14 by a double feedback loop of the rotation rate n and a current i.

Figure 3:
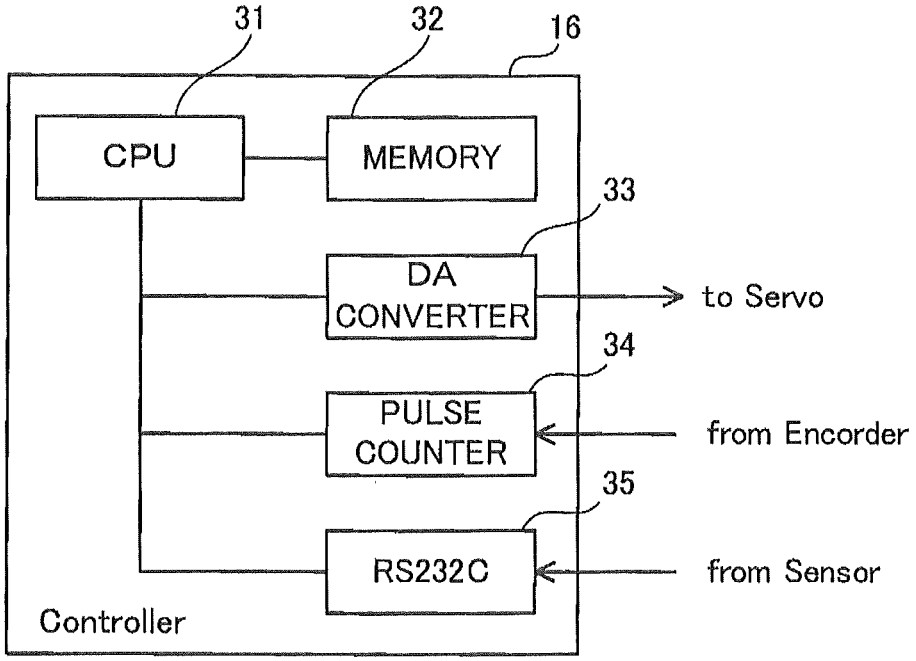
FIG. 3 shows a hardware configuration of a controller.

FIG. 3 shows an embodiment of a hardware configuration of the controller 16. The controller 16 comprises a CPU 31, a memory 32, a D/A converter 33, a pulse counter 34, and an RS232C circuit 35 (serial communication circuit). The D/A converter 33, the pulse counter 34, and the RS232C circuit 35 are connected to the CPU 31 by a PCI bus. The memory 32 stores a program to be executed by the CPU 31 and parameters such as a reaction threshold (to be described later). The D/A converter 33 transmits a rotation rate command value to the servo controller 16*b*. In the present embodiment, since analog signals are inputted to and outputted from the servo controller 16*b*, the D/A converter 33 converts a digital value of a command value calculated by the CPU 31 into an analog value and outputs the analog value. The pulse counter 34 counts a pulse outputted by the encoder 15. The pulse outputted by the encoder 15 corresponds to the rotation rate of the motor 14 (in other words, the rotation rate of the flywheel). The RS232C circuit 35 receives data outputted by the inclination angle sensor 18 and outputs the data to the CPU 31. As is well known, RS232C is a serial communications standard established by the EIA (The Electronic Industries Alliance) in the United States.

An outline of an operation of the balance device 10 will now be described. When the motor 14 accelerates (decelerates) the rotation of the flywheel 20, the reaction torque of the torque applied to the flywheel 20 by the motor 14 acts on the user 91. Since the axis 92 of the flywheel 20 extends in the direction of the roll axis, the reaction torque acts around the roll axis. In other words, by changing the rotation rate of the flywheel 20, the balance device 10 is able to apply the torque around the roll axis (the reaction torque of the flywheel 20) to the user 91. By appropriately selecting a control rule of the flywheel 20, the balance device 10 can apply the reaction torque in a direction in which an inclination angle of the body of the user 91 around the roll axis (X axis) decreases and can also apply the reaction torque in a direction in which the inclination angle increases. In the case of the former, the balance device 10 functions as a balance support device that returns the yaw axis of the user's body to the vertical direction. In the case of the latter, the balance device 10 functions as a training device for improving the user's balance ability.

Figure 4:
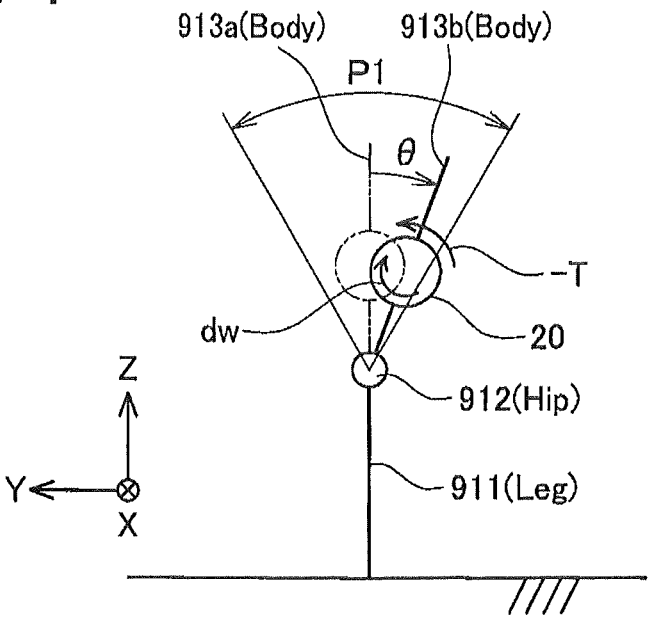
FIG. 4 is a schematic diagram for explaining an operation as a balance support device.

An operation of the balance device 10 as the balance support device will be described with reference to FIG. 4. In FIG. 4, the user 91 is schematically represented by lines. 911 corresponds to a leg of the user 91, 912 corresponds to a waist thereof, and 913*a* and 913*b* correspond to a body thereof. 913*b* represents a case in which the yaw axis (longitudinal direction) of the body is oriented along the vertical direction, and 913*a* represents a case in which the yaw axis is inclined by an angle θ with respect to the vertical direction. The angle θ corresponds to the inclination angle θ of the body.

Reference sign "P1" denotes an angular range around the roll axis (X axis). The first range P1 includes the vertical direction. The first range P1 is set to an angular range in which the user 91 can maintain balance by his/her own power. The first range P1 is determined in advance and is stored in the controller 16. For example, the first range P1 is set to 2 degrees toward both sides for a total of 4 degrees.

The balance device 10 controls the rotation rate of the flywheel 20 so that the reaction torque acts in a direction by which the inclination angle θ of the body of the user 91 is returned toward the vertical direction when the inclination angle θ exceeds the first range P1. Moreover, if a moment of inertia and an angular acceleration of the flywheel 20 are respectively denoted by Iw and dw, then the torque T applied to the flywheel 20 by the motor 14 is expressed as T=Iw·dw. Since a torque in an opposite direction to the torque T applied by the motor 14 acts on the user 91, in FIG. 4, the reaction torque is denoted as "−T". As shown in FIG. 4, when a clockwise angular acceleration dw is applied, a counter clockwise reaction torque "−T" is induced. In other words, when the motor outputs the torque T, the controller 16 of the balance device 10 is able to induce the reaction torque "−T".

A control rule that determines the torque T to be induced by the motor 14 in accordance with the inclination angle θ is given by (Expression 1) below.

$$\text{if } \theta \subset P1 \text{ (condition 1) then} \qquad \text{(Expression 1)}$$
$$T = Iw \cdot dw = 0$$
$$\text{else (condition 2)}$$
$$T = Iw \cdot dw = Kd \cdot d\theta$$

Reference sign Kd denotes control gain. Reference sign dθ denotes a rotation rate of the flywheel 20. A conversion of (Expression 1) into a control rule for determining a desired angular acceleration value dw of the flywheel 20 results in (Expression 2) below.

$$\text{if } \theta \subset P1 \text{ (condition 1) then} \qquad \text{(Expression 2)}$$
$$dw = 0$$
$$\text{else (condition 2)}$$
$$dw = \frac{Kd}{Iw} \cdot d\theta$$

The controller 16 changes the rotation rate of the flywheel 20 based on the desired angular acceleration value dw determined by (Expression 2).

Among the control rules given by (Expression 1) and (Expression 2), Condition 1 represents a case in which the inclination angle θ is in the first range P1. When Condition 1 is satisfied, the controller 16 controls the flywheel 20 so that angular acceleration dw=0 or, in other words, the reaction torque equals zero. Condition 2 represents a case in which the inclination angle θ exceeds the first range P1. The controller 16 controls the flywheel 20 so that a reaction torque "−T=Kd·dθ" with a magnitude proportional to a rate of inclination angle dθ of the body is induced. As described earlier, the reaction torque "−T" is induced in the direction by which the inclination angle θ is returned toward the vertical direction. Therefore, in other words, the controller 16 changes the rotation rate of the flywheel 20 so that the reaction torque acts in the direction by which the inclination angle θ is returned toward the vertical direction when the inclination angle θ exceeds the first range P1. Moreover, the rate of inclination angle dθ is obtained from a time subtraction of the inclination angle θ obtained by the sensor 18.

When the control rule given by (Expression 2) is adopted, the controller 16 of the balance device 10 controls the rotation rate of the flywheel 20 so that the reaction torque equals zero when the inclination angle θ of the body is in the first range P1. On the other hand, the controller 16 changes the rotation rate of the flywheel 20 so that the reaction torque acts in the direction by which the inclination angle θ is returned toward the vertical direction when the inclination angle θ exceeds the first range P1. According to such control rules, the balance device 10 supplies a torque that recovers an inclination angle θ of the user's body around the roll axis to a vertical direction.

An alternative control rule of (Expression 2) will now be explained. The balance device 10 may adopt a control rule given by (Expression 3) instead of (Expression 2).

$$\text{if } \theta \cdot d\theta > 0 \text{ (condition 3) then} \qquad \text{(Expression 3)}$$

$$dw = \frac{Kd}{Iw} \cdot d\theta$$

$$\text{else (condition 4)}$$

$$dw = 0$$

The control rule given by (Expression 3) differs from the case of (Expression 2) with respect to Condition 3. θ·dθ>0 implies θ>0 and dθ>0 or θ<0 and dθ<0. Whether the angle θ is positive or negative is determined by a coordinate system shown in FIG. 4. Condition 3 represents an increase of the inclination angle θ. In other words, Condition 3 represents a falling inclination angle θ. Specifically, in a case where the control rule given by (Expression 3) is adopted, the controller 16 changes the rotation rate of the flywheel 20 so that the reaction torque induced by the change in the rotation rate of the flywheel 20 acts in the direction by which the inclination angle θ is returned toward the vertical direction when the inclination angle θ increases. In addition, the controller 16 controls the rotation rate of the flywheel so that the reaction torque equals zero when the inclination angle decreases.

When the control rule given by (Expression 3) is adopted, regardless of the magnitude of the inclination angle θ, the balance device 10 supplies the reaction torque in the direction by which the inclination angle θ is returned toward the vertical direction when the inclination angle θ increases.

Another alternative control rule of (Expression 2) will now be explained. The balance device 10 may adopt, a control rule given by (Expression 4) instead of (Expression 2).

$$\text{if } \theta \subset P1 \text{ (condition 1) then} \qquad \text{(Expression 4)}$$

$$dw < \frac{T\min}{Iw}$$

$$\text{else (condition 2)}$$

$$dw = \max\left(\frac{Kd}{Iw} \cdot d\theta, \frac{T\min}{Iw}\right)$$

Figure 5:
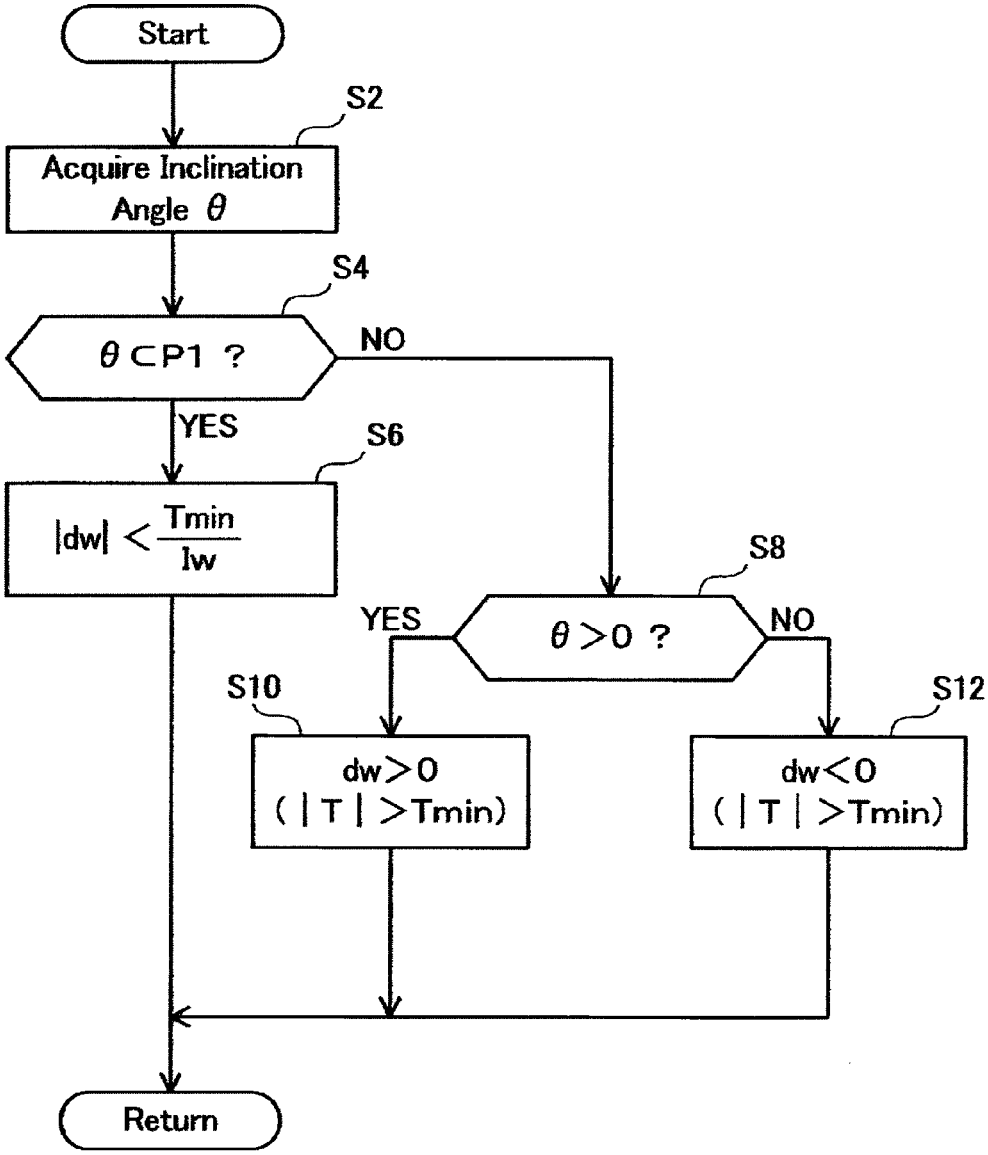
FIG. 5 is a flow chart of processes executed by a balance device.

In the control rule given by (Expression 4), Conditions 1 and 2 are the same as in the case of (Expression 2). Processes performed by the controller 16 based on the control rule given by (Expression 4) are shown in FIG. 5. In the flow chart shown in FIG. 5, positive and negative directions of the inclination angle θ and the angular acceleration dw are provided with respect to the roll axis (X axis) shown in FIG. 4. In other words, the positive direction of the inclination angle A corresponds to the counter clockwise direction shown in FIG. 4. The positive direction of the angular acceleration dw also corresponds to the counter clockwise direction.

The controller 16 acquires an inclination angle θ of the body from the inclination angle sensor 18 (S2). The controller 16 judges whether or not the inclination angle θ is in the first angular range P1 (S4). When the inclination angle θ is in the first angular range P1 (S4: YES), the controller 16 reduces the rotation rate of the flywheel 20 to zero (S6). In (Expression 4) and FIG. 5, Tmin denotes the reaction threshold. In other words, when the inclination angle θ is in the first range P1, the controller 16 controls the rotation rate of the flywheel 20 to keep the reaction torque T induced by the change in the rotation rate of the flywheel 20 at equal to or less than the predetermined reaction threshold Tmin. The reaction threshold Tmin is set to a small value so that the reaction torque does not affect the user. The controller 16 favorably controls the rotation rate of the flywheel 20 so as to stop the rotation rate while satisfying a condition expressed as dw (absolute value) <(Tmin/Iw). Specifically, the balance device 10 reduces the rotation rate of the flywheel 20 to zero when the inclination angle θ is in the first range P1 or, in other words, when the user is maintaining balance of the body. By reducing the rotation rate of the flywheel 20 to zero, the balance device 10 can be prevented from applying unnecessary torque to the user. A gyroscopic torque induced when the direction of the axis of the rotating flywheel changes corresponds to the "unnecessary torque".

Meanwhile, when the inclination angle θ is out of the first angle range P1 (S4: NO), the controller 16 controls an angular acceleration of the flywheel 20 in accordance with the direction of the inclination angle θ (S8). When the inclination angle θ>0 (S8: YES), the controller 16 changes the rotation rate of the flywheel 20 with a positive angular acceleration (S10). When the inclination angle θ<0 (S8: NO), the controller 16 changes the rotation rate of the flywheel 20 with a negative angular acceleration (S12). Conditions are shown simplified in steps S10 and S12 in FIG. 5. Note that the dw condition in steps S10 and S12 corresponds to Condition 2 described earlier. In other words, in steps S10 and S12, the angular acceleration dw of the flywheel 20 is determined so that a magnitude of the reaction torque T becomes greater than the reaction threshold Tmin. The processes of steps S10 and S12 correspond to changing the rotation rate of the flywheel so that the reaction torque acts in a direction by which the inclination angle θ is returned toward the vertical direction with a magnitude greater than the reaction threshold Tmin when the inclination angle θ exceeds the first range P1. The processes in FIG. 5 are realized by a program executed by the controller 16.

The control rule given by (Expression 2) corresponds to a case of Tmin=0 in the control rule given by (Expression 4). In addition, the reaction threshold Tmin introduced in the control rule given by (Expression 4) is also favorably applied to the control rule given by (Expression 3). In this case, the controller 16 changes the rotation rate of the flywheel so that the reaction torque acts in a direction by which the inclination angle θ is returned toward the vertical direction with a magnitude greater than the reaction threshold Tmin when the inclination angle θ increases. Furthermore, the controller 16 controls the rotation rate of the flywheel to keep the reaction torque at equal to or less than the reaction threshold Tmin when the inclination angle θ decreases. In particular, when the inclination angle θ decreases, the controller 16 favorably controls the rotation rate of the flywheel 20 so as to stop the rotation rate while satisfying a condition expressed as dw (absolute value)<(Tmin/Iw). An advantage achieved in this case is as described earlier.

Yet another alternative control rule of (Expression 2) will now be explained. The balance device 10 may adopt a control rule given by (Expression 5) instead of (Expression 2).

$$\text{if } \theta \subset P1 \text{ (condition 1) then} \qquad \text{(Expression 5)}$$

$$dw < \frac{T\min}{Iw}$$

$$\text{else if } \theta \not\subset P1 \text{ and } \theta \cdot d\theta > 0 \text{ (condition 5)}$$

$$dw = \max\left(\frac{Kd}{Iw} \cdot d\theta, \frac{T\min}{Iw}\right)$$

-continued else (condition 6)

$$dw < \frac{T\min}{Iw}$$

The control rule given by (Expression 5) combines a condition dependent of a range of the inclination angle represented by (Expression 2) with a condition dependent on a direction of change in the inclination angle represented by (Expression 3). Condition 1 is the same as the case of the control rule given by (Expression 2). Condition 1 in this control rule indicates controlling the rotation rate of the flywheel to keep the reaction torque at equal to or less than the reaction threshold regardless of a change direction of the inclination angle θ when the inclination angle is in the first range P1. Since the user is more likely to be able to recover balance under his/her own power if the inclination angle θ is in the first range P1, the balance device 10 does not output a reaction torque.

According to Condition 5, the controller 16 changes the rotation rate of the flywheel 20 so that the reaction torque acts in the direction by which the inclination angle θ is returned toward the vertical direction with the magnitude greater than the reaction threshold Tmin when the inclination angle θ is out of the first range P1 and when the inclination angle θ increases. Condition 5 indicates a high likelihood that the user is unable to recover balance under his/her own power. In such a case, the balance device 10 induces a reaction torque for supporting balance recovery.

Since a decrease in the inclination angle θ indicates that balance is being recovered under the user's own power, the balance device 10 does not induce a reaction torque even if the inclination angle θ is out of the first range (Condition 6). The balance device 10 adopting the control rule given by (Expression 5) outputs the reaction torque only when it is highly likely that the user is unable to recover balance under his/her own power.

The balance device 10 also favorably decreases the rotation rate of the flywheel 20 to zero using mechanical frictional resistances of the motor 14 and the flywheel 20. By decreasing the rotation rate to zero without using power, power consumption can be suppressed.

Next, an operation of the balance device 10 as a balance training device will be described with reference to FIG. 6. The balance training device intentionally supplies a disturbance torque when the user 91 is maintaining the inclination angle θ of the body under his/her own power in the proximity of the vertical direction. The reaction torque in the direction that increases the inclination angle θ corresponds to the "disturbance torque". The user attempts to recover the inclination angle θ against the disturbance torque. This attempt corresponds to training for improving balance ability.

Figure 6:
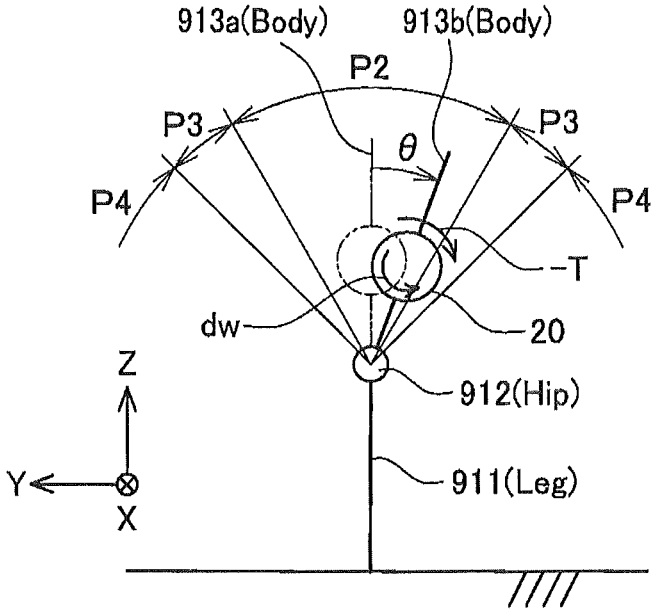
FIG. 6 is a schematic diagram for explaining an operation as a balance training device.

Reference signs P2, P3, and P4 in FIG. 6 denote angular ranges around the roll axis. A second range P2 (an initial range) includes the vertical direction. The second range P2 is set to an angular range in which the user 91 can remain standing in a stable manner by his/her own power. Reference sign P3 denotes an angular range (a third range, or an adjacent range) set on the outside of a boundary of the second range P2. Reference sign P4 denotes a range (a fourth range) having a greater inclination angle than the third range P3.

A control rule executed by the balance device 10 as a balance training device is given by (Expression 6).

if $\theta \subset P2$ (condition 7) then (Expression 6)

$$dw = \min\left(-sig(\theta)\cdot\frac{Kd}{Iw}\cdot\cos(\theta),\ -\frac{T\min}{Iw}\right)$$

else if $\theta \subset P3$ (conditin 8) then $$dw < \frac{T\min}{Iw}$$

else if $\theta \subset P4$ (condition 9) then $$dw = \frac{Kd}{Iw}\cdot d\theta$$

In (Expression 6), "sgn(θ)" denotes a function indicating whether the inclination angle θ is positive or negative. As shown in FIG. 6, when the inclination angle θ has a positive value, the controller 16 accelerates the flywheel 20 in a negative direction (counter clockwise) of the roll axis (X axis). As a result, the reaction torque is in the clockwise direction or, in other words, the direction by which the inclination angle θ is increased. When Condition 7 is satisfied or, in other words, when the inclination angle θ is in the second range P2, the controller 16 changes the rotation rate of the flywheel 20 so that the reaction torque acts in the direction by which the inclination angle θ is increased with the magnitude greater than the reaction threshold. Accordingly, the disturbance torque acts on the user and the inclination angle θ is disturbed. The user attempts to recover the inclination angle θ to the vertical direction. This attempt constitutes training for improving balance ability.

Moreover, the term "sgn(θ)cos(θ)" when Condition 7 is satisfied is an example and, for instance, a constant or the inclination angle θ may be adopted instead of "sgn(θ)cos(θ)".

When Condition 8 is satisfied or, in other words, when the inclination angle θ is in the third range which is defined as the range outside the second range, the controller 16 controls the rotation rate of the flywheel 20 to keep the reaction torque at equal to or less than the reaction threshold Tmin. The balance device 10 does not supply unnecessary reaction torque to the user. The user attempts to recover the inclination angle θ to the vertical direction using his/her own power.

When Condition 8 is satisfied, the controller 16 favorably controls the rotation rate of the flywheel 20 so as to stop the rotation rate while satisfying a condition expressed as dw (absolute value)<(Tmin/Iw). Once the rotation of the flywheel 20 stops, the gyroscopic torque is not induced and the unnecessary torque does not act on the user. In addition, by decreasing the rotation rate using mechanical frictional resistance, the power consumption can be suppressed.

When Condition 9 is satisfied or, in other words, when the inclination angle θ exceeds the third range and increases, the controller 16 changes the rotation rate of the flywheel 20 so that the reaction torque acts in the direction by which the inclination angle θ is returned toward the vertical direction with the magnitude greater than the reaction threshold Tmin. In other words, when the inclination angle θ exceeds the third range and increases, the balance device 10 supports balance recovery.

In the condition rule given by (Expression 6), the reaction threshold Tmin may be set to zero. An alternative control rule that is more detailed than the control rule of (Expression 6) is given by (Expression 7).

if $\theta \subset P2$ and $\theta \cdot d\theta \geq 0$ (condition 10) then (Expression 7)

$$dw = -sig(\theta) \cdot \frac{Kd}{Iw} \cdot \cos(\theta)$$

else if $\theta \subset P2$ or $\theta \subset P3$ (condition 11) then $$dw = 0$$

else if $\theta \subset P4$ and $\theta \cdot d\theta > 0$ (condition 12) then $$dw = \frac{Kd}{Iw} \cdot d\theta$$

else (condition 13)

$$dw = 0$$

A condition given by "θ·dθ≥0" in Condition 10 represents a case in which the inclination angle θ increases. In other words, when the inclination angle θ is in the second range P2 and increases, the balance device 10 induces a reaction torque (a disturbance torque) in a direction by which the inclination angle θ is increased. Moreover, the second range P2 is set in advance to a range in which the inclination angle θ of the body is close to the vertical direction and in which upper body balance is stable.

When Condition 11 is satisfied or, in other words, when the inclination angle θ is in the second range P2 and decreases (that is, when the user is attempting to return the inclination angle to the vertical direction) and when the inclination angle θ is in the third range, the balance device 10 does not induce a reaction torque.

When Condition 12 is satisfied or, in other words, when the inclination angle θ is in the fourth range P4 and increases, the balance device 10 induces the reaction torque in a the direction by which the inclination angle θ is returned toward the vertical direction. In a case other than the above (Condition 13), the balance device 10 does not induce the reaction torque. By adopting the control rule given by (Expression 7), effective balance training can be achieved.

Second Embodiment

Figure 7:
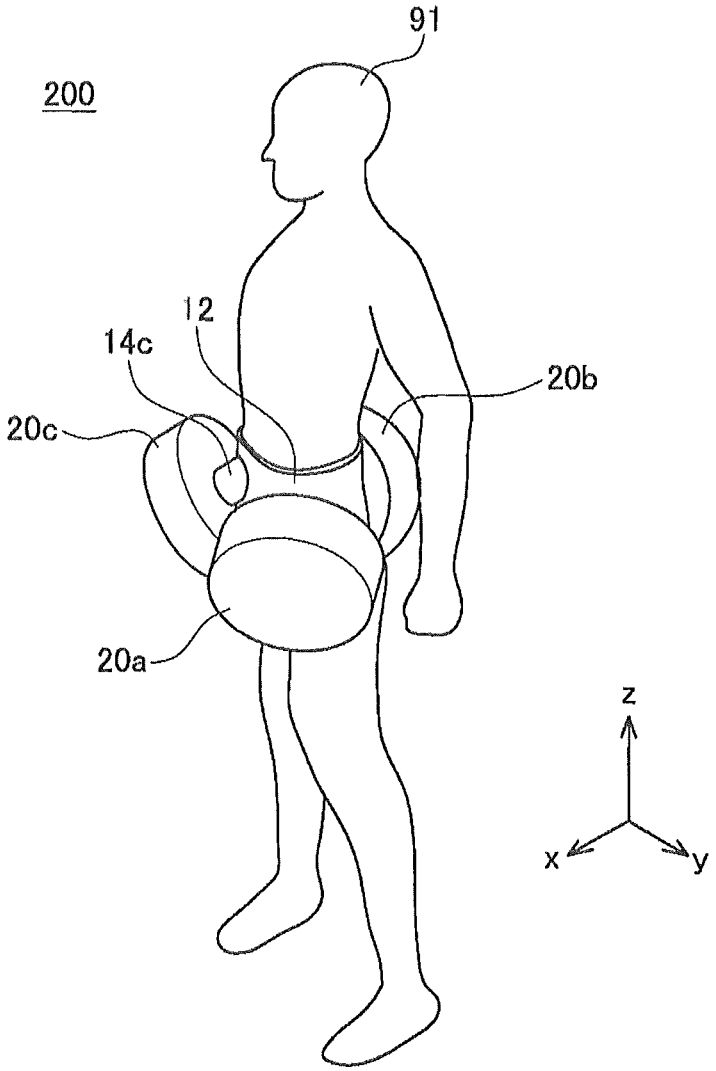
FIG. 7 is a schematic perspective view of a balance device according to a second embodiment.

A balance device 200 according to the second embodiment will now be described. FIG. 7 shows a schematic perspective view of the balance device 200 attached to a user 91. The balance device 200 comprises three flywheels 20*a*, 20*b*, and 20*c*. The three flywheels are attached to the user by a corset 12. The flywheel 20*b* is arranged behind the user 91, and the remaining flywheels are respectively arranged to the left and right in front of the user 91. As will be described later, the three flywheels are arranged so that respective axes of the flywheels are non-parallel with one another and that the three axes are not arranged on one plane. By adopting such an arrangement, the balance device 200 is able to independently induce a reaction torque around each of the three axes. The balance device 200 is not only capable of supporting recovery of inclination angles around a roll axis and a pitch axis but is also capable of supporting turning of the body around a yaw axis of the body to a desired yaw angle. Alternatively, such a balance device 200 can not only provide balance training in regards to inclination angles around the roll axis and the pitch axis but can also provide balance training around the yaw axis of the body.

Figure 8:
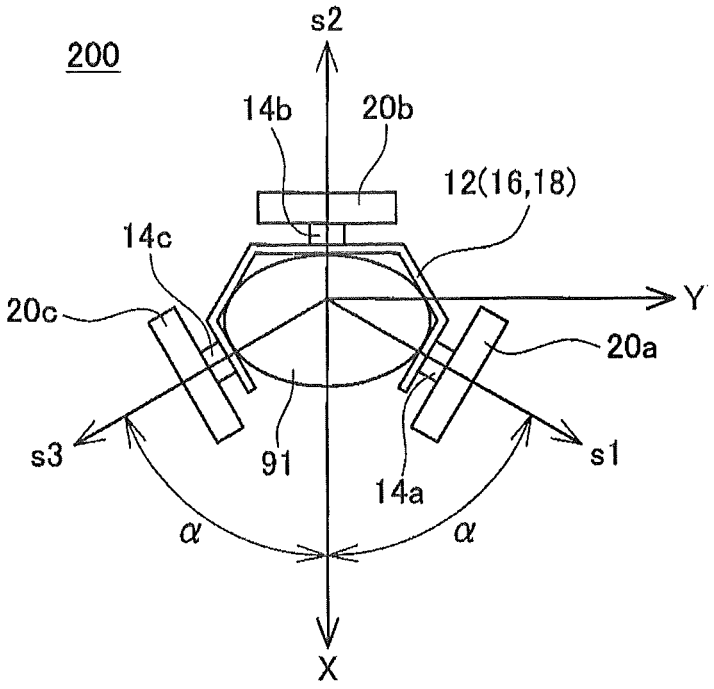
FIG. 8 is a schematic plan view of the balance device according to the second embodiment.

A reaction torque that can be induced by the balance device 200 will now be described with reference to FIGS. 8 and 9. FIG. 8 is a schematic plan view of the balance device 200. In a similar manner to the balance device 10 according to the first embodiment, with the balance device 200 according to the second embodiment, a sensor 18 that measures an inclination angle and a controller 16 are installed in a corset 12 holding a flywheel. Three flywheels 20*a*, 20*b*, and 20*c* are mounted to the corset 12 via motors 14*a*, 14*b*, and 14*c*. Reference signs s1, s2, and s3 in the drawing respectively denote rotation axes of the flywheels. The flywheel 20*b* is arranged behind the user 91. The remaining flywheels 20*a* and 20*c* are mounted to both sides of the roll axis (X axis) at azimuth angles α in a plan view. The azimuth angle α refers to an angle between the roll axis (X axis) and an axis of a flywheel on an XY plane. In a plan view, the three rotation axes s1, s2, and s3 intersect one another at approximately a center of the body of the user.

Figure 9:
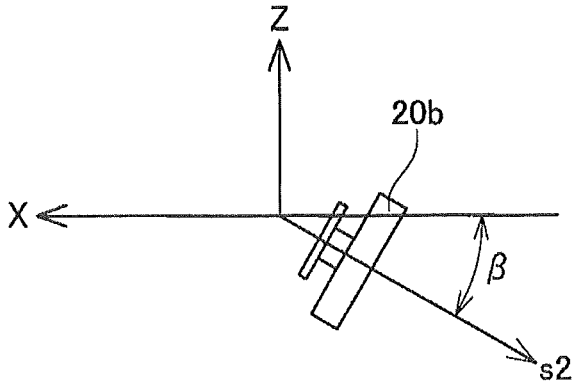
FIG. 9 is a schematic partial side view of the balance device according to the second embodiment.

FIG. 9 shows a mounting angle of the flywheel 20*b* on an XZ plane. The flywheel 20*b* is mounted inclined downward by an elevation angle β from the roll axis (X axis) on the XZ plane. The other two flywheels are similarly mounted at elevation angles β. In other words, the three flywheels are arranged so that respective axes of the flywheels are non-parallel with one another and that the three axes are not arranged on one plane.

Directions of the three rotation axes s1, s2, and s3 in an XYZ coordinate system are given by (Expression 8) below. In (Expression 8), s1, s2, and s3 are unit vectors representing directions of the rotation axes.

$$s1 = R(\alpha, \beta)[1, 0, 0]^T \quad \text{(Expression 8)}$$

$$s2 = R(\pi, \beta)[1, 0, 0]^T$$

$$s3 = R(-\alpha, \beta)[1, 0, 0]^T$$

$$R(\alpha, \beta) = \begin{bmatrix} \cos\alpha() & -\sin\alpha() & 0 \\ \sin\alpha() & \cos\alpha() & 0 \\ 0 & 0 & 1 \end{bmatrix} \begin{bmatrix} \cos\beta() & 0 & \sin\beta() \\ 0 & 1 & 0 \\ -\sin\beta() & 0 & \cos\beta() \end{bmatrix}$$

R(α,β) is a function signifying a product of a rotational transform of the angle α around the yaw axis (Z axis) and a rotational transform of the angle β around the pitch axis (Y axis). The rotational transform function is well known.

When reaction torques induced by the respective flywheels are denoted by T1, T2, and T3, then a resultant reaction torque Td of the reaction torques is expressed as Td=T1·s1+T2·s2+T3·s3. In this case, s1, s2, and s3 are unit vectors as described earlier. The present inventors studied a relationship among the azimuth angle α, the elevation angle β, and reaction torques induced around the respective axes. The study was performed by decomposing the resultant reaction torque Td into a component torque Tx around the roll axis, a component torque Ty around the pitch axis, and a component torque Tz around the yaw axis. As a result, the following findings were made.

When the torque Ty around the pitch axis reaches maximum, the torques Tx and Tz are zero independent of the azimuth angle α and the elevation angle β. When the torque Tz around the yaw axis reaches maximum, the torque Ty is zero independent of the azimuth angle α and the elevation angle β. In this case, the torque Tx is dependent on the azimuth angle α. When the azimuth angle α=60 degrees, Tx is approximately zero. When the torque Tx around the roll axis reaches maximum, the torque Ty is zero independent of the azimuth angle α and the elevation angle β. In this case, the torque Tz is dependent on the azimuth angle α and the elevation angle β. When the elevation angle β=0 degrees, Tz is approximately zero. As the elevation angle β increases, the torques Tx and Ty decrease while the torque Tz increases.

The study described above revealed that by adopting a 60 degree-azimuth angle α and a variable elevation angle β, a reaction torque can be induced around any axis. Moreover, the balance device 200 shown in FIGS. 8 and 9 adopts an azimuth angle α of 60 degrees.

Third Embodiment

Figure 10:
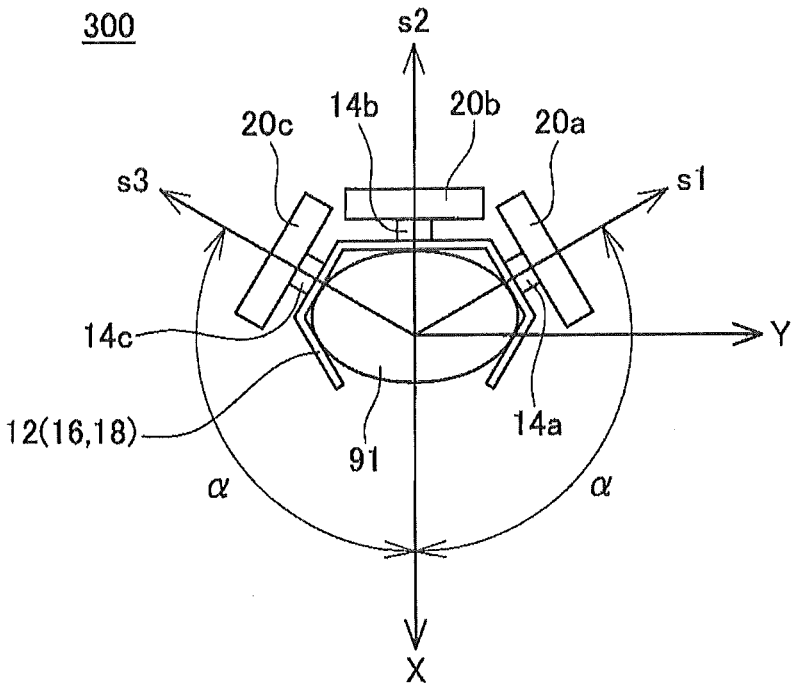
FIG. 10 is a schematic plan view of a balance device according to a third embodiment.

A balance device 300 according to the third embodiment is shown in FIG. 10. The balance device 300 is a modification of the balance device 200 according to the second embodiment. In the balance device 300 shown in FIG. 10, one flywheel 20*b* is arranged behind a corset 12 (behind a user) and remaining two flywheels 20*a* and 20*c* are arranged at azimuth angles α of 120 degrees. The balance device 300 shown in FIG. 10 is also capable of inducing a reaction torque around any axis by varying an elevation angle β.

The balance devices 200 and 300 control the rotation rate of each flywheel so that a resultant torque of the reaction torques induced by the three flywheels 20*a*, 20*b*, and 20*c* performs the same function as the single flywheel 20 according to the first embodiment. In other words, when the balance devices 200 and 300 are used as a balance support device, under a predetermined condition, the balance devices 200 and 300 control the rotation rate of each flywheel so that the resultant torque acts in a direction by which an inclination angle is returned toward a reference direction with a magnitude greater than a reaction threshold. Under other conditions, the balance devices 200 and 300 control the rotation rate of each flywheel to keep the resultant torque at equal to or less than the reaction threshold. A same specific control rule (a condition for changing rotation rate) as in the first embodiment may be adopted. In addition, the balance devices 200 and 300 may be used as a balance training device in a similar manner to the balance training device described in the first embodiment.

Other technical features of the balance device according to the present embodiments will be listed below.

(1) The three flywheels are arranged around the body at intervals of approximately 120 degrees in plan view.

(2) The three flywheels are arranged so that the rotation axes of the three flywheels intersect one another at approximately one point inside the body of the user when the balance device is attached to the user.

(3) The greater the rate of inclination angle when the body inclines, the greater an amount by which the rotation angle rate of the flywheel is increased by the controller.

Considerations for the balance device above will be described below. Specifications of a balance device experimentally created by the present inventors are as follows. The flywheel 20 has a diameter of approximately 30 cm and a mass of approximately 1.5 kg. A brushless motor is used as the motor 14. The motor has an output of 60 W and a maximum output torque of 9 Nm. The maximum rotation rate is 2000 rpm. The gear ratio is 3:2. An experiment performed using such a balance device confirmed that the balance device is effective in recovering an inclination angle of a user.

In the balance device 10 according to the first embodiment, the flywheel is arranged so that the axis of the flywheel is pointed in the direction of the roll axis. The flywheel of the balance device may be arranged so that the axis of the flywheel is pointed in the direction of the pitch axis. In this case, balance support can be provided with respect to an inclination angle of the body around the pitch axis. Alternatively, such a balance device can provide balance training around the pitch axis.

The balance device may comprise two flywheels with respective rotation axes that intersect each other in a plane formed by the pitch axis and the roll axis. The two flywheels arranged in this manner are capable of inducing a reaction torque around a straight line in any direction in the plane formed by the pitch axis and the roll axis. In other words, a balance device comprising the two flywheels described above is capable of providing support or training with respect to inclination angles around the pitch axis and the roll axis.

The inclination angle sensor may be replaced with an angle sensor that measures an angle of each joint of the legs and a ground sensor. This is because an inclination angle of the body can be calculated from the angles of the respective joints of the legs that are in contact with the ground.

The reaction threshold Tmin need only be set to a small value so that a reaction torque does not affect the user. Favorably, the reaction threshold Tmin is substantially zero. The controller 16 favorably controls the rotation rate of the flywheel 20 so as to stop the rotation rate while ensuring that the reaction torque is equal to or less than the reaction threshold Tmin (a small value that may be deemed to be substantially zero).

The balance devices according to the embodiments constitute feedback control in which a rotation rate of a flywheel is detected and fed back in order to obtain a desired reaction torque (for example, refer to FIG. 2). The motor can also be controlled so as to output a desired torque by current control. The balance devices disclosed in the present specification may also be preferably configured so as to obtain a desired reaction torque by current feedback control without adopting rotation rate feedback. Moreover, an angular acceleration and an output torque of a flywheel are proportional to a current supplied to a motor. Therefore, it should be noted that current feedback control is equivalent to rotation rate feedback from the perspective of outputting a desired reaction torque.

Furthermore, note that rotation rate feedback has the following advantages. Rotation rate feedback enables control in which the rotation rate of the flywheel is maintained at zero. Rotation rate feedback also enables control that prevents a maximum allowable rotation rate from being exceeded.

While preferred embodiments of the present invention have been described using specific terms, such description is for illustrative purposes only and are not intended to limit the scope of the following claims. The techniques described in the claims include various modifications and changes made to the specific embodiments illustrated above.

The technical elements described in this specification or in the drawings exhibit technical utility singly or in various combinations and are not limited to the combinations recited in the claims as filed. Moreover, the techniques illustrated in this specification or in the drawings simultaneously attain a plurality of purposes, whereby even attaining one of the purposes per se offers technical utility.

REFERENCE SIGNS LIST

10: balance device, 12: corset, 14: motor, 16: controller, 18: inclination angle sensor, 20: flywheel, 200, 300: balance device.

The invention claimed is:

1. A balance device to be attached to a body of a user, the balance device comprising:

a sensor configured to detect an inclination angle of the body with respect to a predetermined reference direction;

at lease one flywheel having an axis being arranged non-parallel to a yaw axis when the balance device is attached to the user; and a controller configured to change a rotation rate of the flywheel based on the inclination angle detected by the sensor, wherein the controller is configured to change the rotation rate of the flywheel so that a reaction torque induced by a change in the rotation rate of the flywheel acts in a direction by which the inclination angle is increased when the inclination angle is in a predetermined initial range that includes the inclination angle=0, and control the rotation rate of the flywheel to keep the reaction torque at equal to or less than a reaction torque threshold when the inclination angle goes out from the initial range.

2. The balance device of claim 1, wherein the controller is configured to:

control the rotation rate of the flywheel to keep the reaction torque at equal to or less than the reaction torque threshold when the inclination angle is in an adjacent range which is defined as a range outside the initial range, and change the rotation rate of the flywheel so that the reaction torque acts in a direction by which the inclination angle is returned toward the inclination angle=0 with a magnitude greater than the reaction torque threshold when the inclination angle goes out from both the initial range and the adjacent range.

3. The balance device of claim 2, wherein the controller is configured to reduce the rotation rate of the flywheel to zero when the inclination angle is in the adjacent range.

4. The balance device of claim 1 comprising three flywheels arranged so that axes of the three flywheels are arranged non-parallel to each other, and all of the axes are not arranged in one plane.

5. A non-transitory computer-readable recording medium storing computer-readable instructions for balance training performed by a balance device that has at least one flywheel having an axis being arranged non-parallel to a yaw axis when the balance device is attached to a body of a user, the computer-readable instructions, when executed by a processor of the balance device, causing the balance device to:

measure an inclination angle of the body with respect to a predetermined reference direction;

judge whether or not the inclination angle is in a predetermined initial range that includes the inclination angle=0; and change the rotation rate of the flywheel so that a reaction torque induced by a change in the rotation rate of the flywheel acts in a direction by which the inclination angle is increased when the inclination angle is in the initial range, and to control the rotation rate of the flywheel to keep the reaction torque at equal to or less than the reaction torque threshold when the inclination angle goes out from the initial range.

* * * * *